US005551404A

United States Patent [19]

Bauerle et al.

[11] Patent Number: 5,551,404

[45] Date of Patent: Sep. 3, 1996

[54] FUEL INJECTION SYSTEM FOR MARINE ENGINES

[75] Inventors: David D. Bauerle, Chesterfield Township; Kevin R. Liske, Madison Heights, both of Mich.

[73] Assignee: Coltec Industries Inc., New York, N.Y.

[21] Appl. No.: 164,705

[22] Filed: Dec. 10, 1993

[51] Int. Cl.[6] ..... F02M 37/04

[52] U.S. Cl. ..... 123/514; 123/541; 123/497

[58] Field of Search ..... 123/541, 497, 123/514

[56] References Cited

U.S. PATENT DOCUMENTS

| | | | |
|---|---|---|---|
| 3,973,536 | 8/1976 | Zelders | 123/541 |
| 4,072,138 | 2/1978 | Hawkins | 123/541 |
| 4,235,205 | 11/1980 | Fukui | 123/463 |
| 4,411,239 | 10/1983 | Kelch | 123/541 |
| 4,503,832 | 3/1985 | Pelfley | 123/541 |
| 4,872,438 | 10/1989 | Ausiello | 123/541 |
| 4,920,942 | 5/1990 | Fujimori | 123/497 |
| 4,926,829 | 5/1990 | Tockey | 123/497 |
| 5,085,193 | 2/1992 | Morikawa | 123/497 |

FOREIGN PATENT DOCUMENTS

| | | | |
|---|---|---|---|
| 0128653 | 10/1980 | Japan | 123/541 |

*Primary Examiner*—Carl S. Miller
*Attorney, Agent, or Firm*—Howard S. Reiter

[57] ABSTRACT

A fuel injection system for engines and, in particular, internal combustion engines used on marine vessels, is disclosed including a fuel injection system having a supply port for receiving fuel at a rate in excess of the controlled rate, an injection port for discharging fuel into the engine at the controlled rate and a return port for conducting fuel in excess of that discharged from the injection port from the injection system. The fuel injection system also includes a pump having an inlet directly connected by a first conduit to a return port and an outlet directly connected by a second conduit to the supply port, a third conduit system for conducting fuel from the supply tank into the first conduit at a first location between the return port and the inlet, and a pressure regulating system for maintaining the pressure at the return port at a predetermined substantially constant super-atmospheric pressure.

20 Claims, 2 Drawing Sheets

FUEL INJECTION SYSTEM FOR MARINE ENGINES

FIELD OF THE INVENTION

The invention relates to a fuel injection system for injecting fuel from a fuel supply tank at a variable controlled rate into an internal combustion engine and, in particular, fuel injection systems including a supply port for receiving fuel at a rate in excess of the controlled rate, an injection port for discharging fuel into the engine at the controlled rate, and a return port for conducting fuel in excess of that discharged from the injection port.

BACKGROUND OF THE INVENTION

Vehicles, and particularly those having a combustion engine with a fuel injection system, use a fuel pump to transport fuel from the fuel tank to the engine in quantities in excess of the engine needs under normal operating conditions. The excess fuel is returned to the fuel tank. If fuel is returned to the tank, vaporization is not a concern. Vaporization is a problem if a return line to the tank is not used. Various devices and systems have been developed in an attempt to overcome the problem of the fuel flashing to vapor, mostly with limited success. The present invention attempts to resolve the perceived disadvantages and shortcomings of the previously proposed solutions to the vaporization problem in fuel injection systems. This present system also serves to eliminate the return line to the tank and the safety hazards associated with the return line.

SUMMARY OF THE INVENTION

The fuel injection system according to the present invention is an adaptation of existing automotive type systems. The system has been modified for use in, but is not limited to, marine applications, namely gasoline powered inboard engines, also gasoline powered jet propulsion systems, sometimes referred to as "jet drives" and gasoline stern drive engines. The significant feature of the present invention is the elimination of the fuel return line to the fuel tank, which is common with most, if not all, fuel injection systems.

The elimination of this line is accomplished in one embodiment by using the existing variable displacement fuel pump to maintain pressure not only on the inlet side of the positive displacement fuel injection pump, but also on the outlet side of the injection unit. Displacement of these pumps is controlled through internal valving. These pumps are current production pumps for carbureted engines. Since the boiling point of a liquid is proportional to the pressure it is being maintained at, keeping pressure on the outlet side of the injection unit prevents the return fuel from flashing to vapor. By controlling the formation of vapor, it is not necessary to return the unused fuel to the tank and replenish it with fresh, cooler fuel. Therefore, the return fuel can be routed directly back to the inlet side of the fuel injection pump. This eliminates the need for a return fuel line to the fuel tank and allows the entire fuel injection system to be installed on the engine itself. In cases where extreme engine compartment temperatures are present, an optional fuel-to-water heat exchanger can be installed in the return fuel line to further prevent fuel vaporization.

Alternatively, the elimination of the fuel return line to the fuel tank can be accomplished by using a variable regulator (either mechanical or electrical) and a restriction that maintains pressure to the outlet side of the injection unit, throughout the entire engine revolution per minute versus load range. When an engine is idling most of the fuel being supplied to the inlet side of the injection unit is being dumped to the outlet side of the injection unit, because the engine does not use much fuel at this speed. Keeping pressure on the outlet side of the injection unit prevents the return fuel from flashing to a vapor. A calibrated restriction can be used to achieve the desired pressure in the return line, where the variable regulator is at the full open position when the engine is idling. As the engine speed/load increases, less fuel is being dumped to the outlet side of the injection unit. If only a restriction was used, it would now be too large to maintain the desired pressure because of the decrease of fuel to it. At this point the variable regulator starts closing to maintain the desired pressure. As the engine speed/load decreases and more fuel is being dumped to the outlet side of the injection unit, the variable regulator would open up to allow more fuel to pass through the restriction. By controlling the formation of vapor, it is not necessary to return the unused fuel to the tank and replenish it with fresh, cooler fuel. Therefore, the return fuel can be routed directly back to the inlet side of the electric fuel injection pump. This eliminates the need for a return fuel line to the fuel tank and allows the entire fuel injection system to be installed on the engine itself. In the case where extreme engine compartment temperatures are present, an optional fuel-to-water heat exchanger can be installed in the return fuel line to further prevent fuel vaporization.

In both embodiments of the present application, fuel is continuously circulated in a closed loop in which a positive displacement fuel pump has its outlet connected to the injector inlet and the injector outlet is connected to the fuel pump inlet. Fuel from the tank, in both cases, flows into the closed loop at a point between the injector outlet and fuel pump inlet. If fuel is continuously circulated in the closed loop, the fuel temperature and pressure would be such so as to vaporize the fuel at the outlet side of the injector. In a conventional system, fuel from the outlet side of the injectors is returned to the fuel tank and the continuous circulation of the unused fuel from the outlet side of the injectors through the cooler fuel in the tank apparently minimizes or eliminates the vaporization problem. By maintaining a reasonably high fuel pressure at the outlet side of the injector, vaporization can be prevented so that fuel from the outlet side of the injector may be returned directly to the inlet side of the positive displacement fuel pump, thereby eliminating the necessity of a fuel return line to the fuel tank.

In one embodiment, pressure at the outlet side of the injector is maintained by a variable displacement fuel pump connected between the fuel tank and the closed loop. Essentially, the constant pressure pump supplies fuel to the closed loop at the same rate fuel is withdrawn from the closed loop by the injector. The constant pressure pump has displacement varied proportional to engine speed and functions to maintain a positive pressure in that portion of the closed loop between the injector outlet and positive displacement fuel pump inlet. The constant pressure pump may be of mechanical or electrical design.

In the other embodiment, a variable restriction is placed in the closed loop at the outlet side of the injector with the size of the restriction being varied inversely proportional to the engine speed. This maintains a constant pressure at the outlet side of the injector, the positive displacement fuel pump intake drawing fuel from both the downstream side of the restriction and from the tank. A relatively high pressure is maintained at the outlet side of the injector essentially by retarding the rate at which fuel may flow from this outlet. This retardation of flow is achieved in one embodiment by a counter or opposing flow of fuel from the variable displacement fuel pump, while in the other embodiment flow of fuel from the injector outlet is retarded by the variable restriction.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
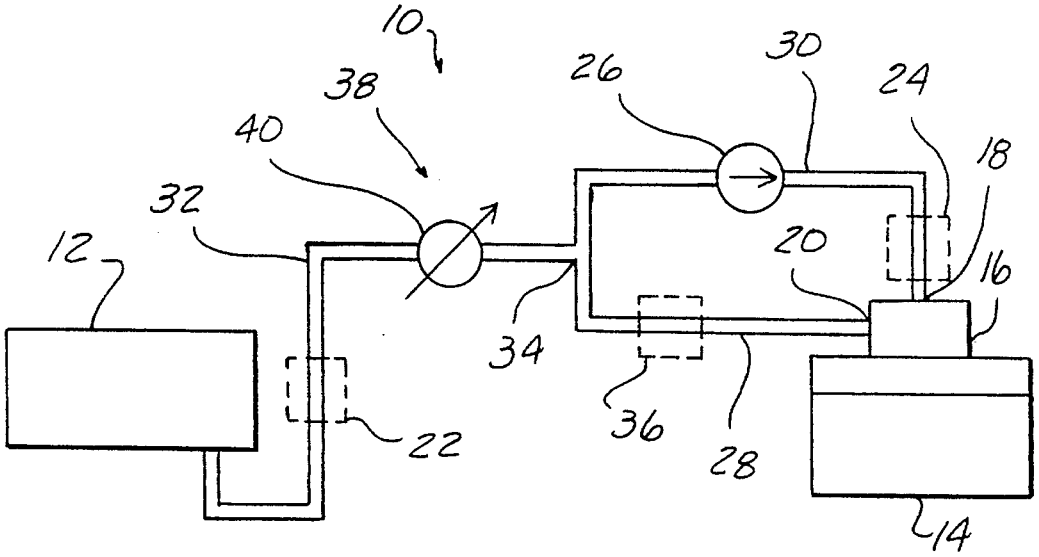
FIG. 1 is a simplified schematic view of a first embodiment of a fuel injection system according to the present invention.
Figure 2:
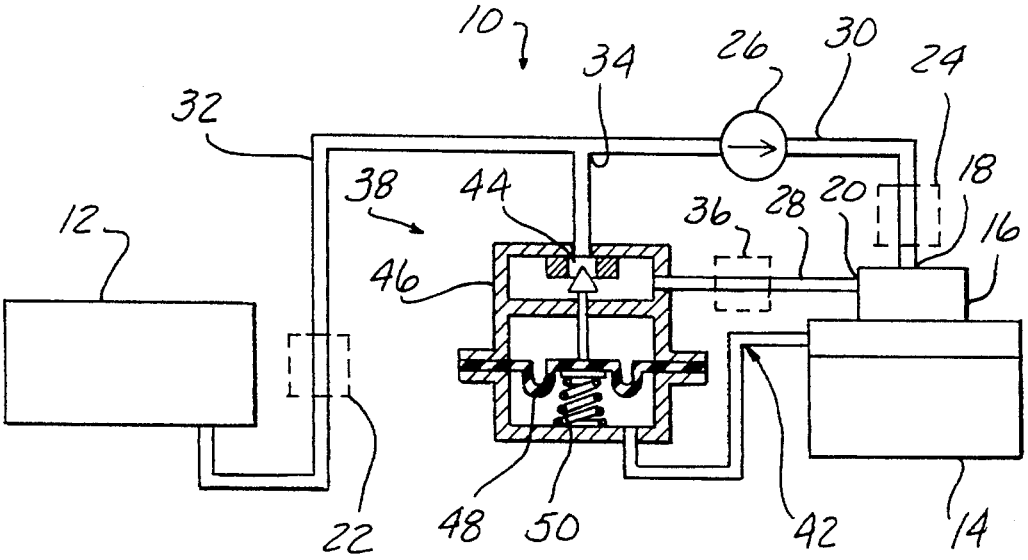
FIG. 2 is a simplified schematic view of a second embodiment of a fuel injection system according to the present invention.
Figure 3:
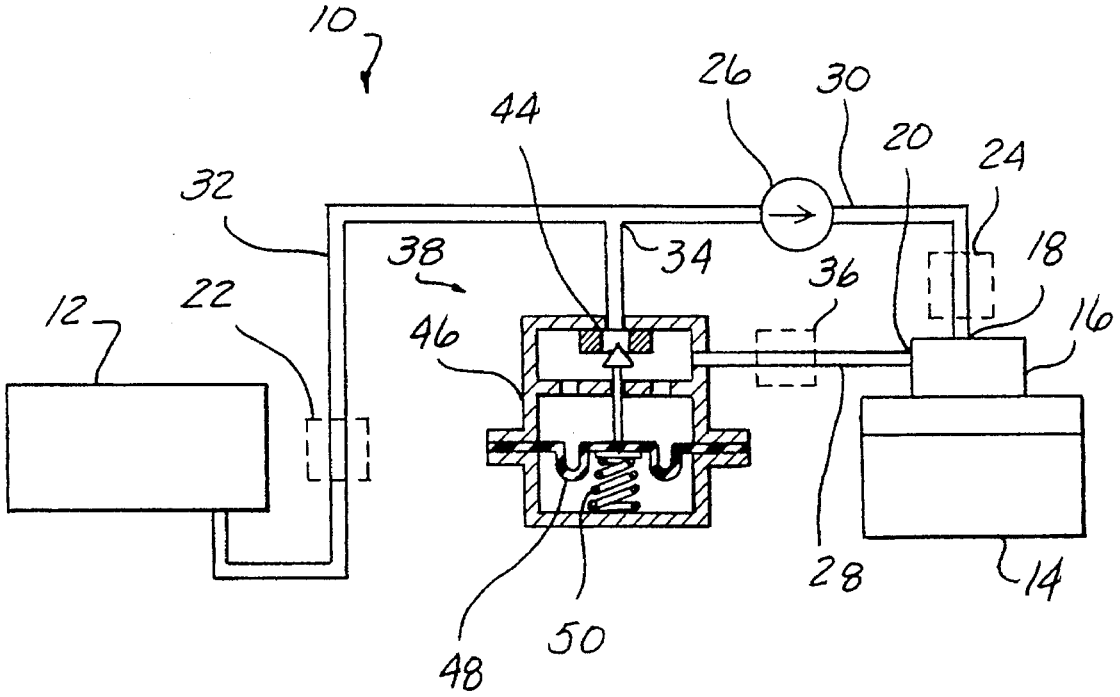
FIG. 3 is a simplified schematic view of an alternative configuration of the second embodiment of a fuel injection system according to the present invention.

As depicted in FIGS. 1, 2 and 3, the present invention includes a fuel injection system, generally designated as 10, for injecting fuel from a fuel supply tank 12 at a variable controlled rate into an internal combustion engine 14. The fuel injection system 10 includes fuel injection means 16 having a supply port 18 for receiving fuel at a rate in excess of the controlled rate. An injection port (not shown) is provided for discharging fuel into the engine 14. The injection port can be located in the throttle body or in the cylinder as is conventional in the art. A return port 20 is also provided for conducting fuel in excess of that discharged from the injection port through the fuel injection means 16. As is conventional, the fuel injection system 10 may also include a fuel filter and/or water separator 22 in the fuel line from the fuel supply tank 12. An injection fuel filter 24 may also be provided in the fuel supply line leading to the supply port 18 from a fuel injection pump means 26. The fuel injection pump means 26 has an inlet directly connected by a first conduit 28 to the return port 20 and an outlet directly connected by a second conduit 30 to the supply port 18. Third conduit means 32 is provided for conducting fuel from the supply tank 12 into the first conduit 28 at a first location 34 between the return port 20 and the inlet to the pump means 26. If required for a particular application, cooler means 36 for cooling fuel in the fuel line extending from the return port 20 may also be provided. Cooler means 36 may be needed in high ambient temperature conditions, such as may exist in Florida, or shallow lakes. The present design eliminates unnecessary modifications to the boat hull. In each embodiment of the present invention, pressure regulating means 38 is provided for maintaining the pressure of fuel at the return port 20 at a predetermined substantially constant super-atmospheric pressure.

Referring now specifically to FIG. 1, the pressure regulating means 38 can include a constant pressure pump 40 in the third conduit means 32 for pumping fuel from the supply tank 12 to the first location 34 in the first conduit 28. The constant pressure pump 40 may be of mechanical or electrical design to maintain a substantially constant, positive pressure in first conduit 28. The constant pressure pump supplies a variable amount of fuel based on the engine's requirements. Pump 40 is the same type of pump that has been used on carbureted engines for many years. As previously described, the fuel injection means 16 may supply fuel to an injection port in the throttle body, or to a multi-port or timed port engine configuration. As the engine speed increases, the volume of fuel supplied by the constant pressure pump 40 is increased to replace the amount of fuel being supplied through the injection ports. Typically, the fuel injection port is supplied with 15–20 pounds per square inch input fuel pressure for a throttle body type injection system.

Referring now specifically to FIG. 2, the pressure regulating means 38 of the second embodiment of the present invention includes a variable restriction 44 in the first conduit 28 at a location between the return port 20 and the first location 34. The variable restriction 44 may take the form of a variable restriction valve 46 connected through control means 42 for operably varying the degree and/or duration of the restriction opening. The control means 42 may take the form of either electrical or mechanical control components, or a combination of the two as is known to those skilled in the art of control systems. The variable restriction 44 may operably provide an effective flow area upon actuation of the valve 46 which varies from a minimum effective flow area to a maximum effective flow area. This may be achieved by increasing the actual area for fuel flow upon actuation of the valve 46, or may also be achieved by, but not limited to, a computer operated duty cycle providing for variable on/off operation of a fixed flow area restriction 44 to provide an effective flow area depending upon the ratio of restriction open time to restriction closed time. As shown in FIG. 2, the variable restriction is controlled by vacuum through line 42 acting against diaphragm 48 and spring 50. In the alternative, as shown in FIG. 3, the effective flow area may be controlled by fuel pressure in combination with the calibrated orifice 44. In this instance, the fuel pressure acts on the diaphragm 48 against the urgings of spring 50 to control the effective flow area.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In a fuel injection system for injecting fuel from a fuel supply tank at a variable controlled rate into an internal combustion gasoline engine, said system including fuel injection means having a supply port for receiving fuel at a rate in excess of said controlled rate, an injection port for discharging fuel into said engine at said controlled rate, and a return port for conducting fuel in excess of that discharged from said injection port from said injection means;

the improvement wherein said system further comprises pump means having an inlet connected by a first conduit to said return port and an outlet directly connected by a second conduit to said supply port, third conduit means for conducting fuel from said supply tank into said first conduit at a first location between said return port and said inlet, and pressure regulating means for maintaining the pressure at said return port at a predetermined substantially constant super-atmospheric pressure to prevent said fuel from flashing to vapor downstream of said fuel injection means.

2. The improvement of claim 1 wherein said pressure regulating means comprises a variable restriction in said first conduit at a location between said return port and said first location.

3. The improvement of claim 2 further comprising control means for operably varying an effective flow area of said variable restriction to maintain a substantially constant, positive pressure in said first conduit.

4. The improvement of claim 1 wherein said pressure regulating means comprises a constant pressure pump in said third conduit means for pumping fuel from said tank to said first location in said first conduit.

5. The improvement of claim 4 wherein said constant pressure pump is a mechanical displacement pump.

6. The improvement of claim 4 wherein said constant pressure pump is an electrical displacement pump.

7. The improvement of claim 1 further comprising means for cooling fuel in said first conduit.

8. In a fuel injection system for an internal combustion gasoline engine having an intake manifold, fuel injection means for injecting fuel into said manifold at a variable rate between a minimum and maximum rate to vary the speed of said engine, constant displacement pump means having an inlet connected to a fuel supply tank and an outlet connected to said injection means for pumping fuel to said injection means at a constant rate in excess of said maximum rate at which fuel is injected into said manifold by said injection means, said injection means including return line means for conducting from said injection means fuel in excess of the fuel injected into said manifold;

the improvement comprising means for connecting said return line means to said inlet of said pump means at a location between said inlet and said supply tank, and means for maintaining fuel in said return line means at a pressure above the flash point of the fuel to prevent said fuel from flashing to vapor in said return line means adjacent said fuel injection means.

9. The improvement of claim 8 wherein said means for maintaining fuel in said return line means comprises a variable restriction in said return line means.

10. The improvement of claim 9 further comprising control means for operably varying an effective flow area of said variable restriction to maintain a substantially constant, positive pressure in said return line means.

11. The improvement of claim 8 further comprising means for cooling fuel in said return line means.

12. A fuel injection system for injecting fuel from a fuel supply tank at a variable controlled rate between a minimum rate and a maximum rate into an internal combustion gasoline engine to vary the speed of the engine comprising:

fuel injection means communicating with said internal combustion engine and having a supply port for receiving fuel at a rate in excess of said controlled rate, and a return port for conducting fuel in excess of that discharged from an injection port of said injection means;

pump means having an inlet connected by a first conduit to said return port and said fuel tank, said pump means further having an outlet connected by a second conduit to said supply port; and pressure regulating means for maintaining the pressure at said return port at a predetermined substantially constant super-atmospheric pressure, said predetermined pressure above a flash point of said fuel to prevent said fuel from flashing to vapor at said return port of said fuel injection means.

13. The fuel injection system of claim 12 wherein said pressure regulating means comprises a variable restriction in said first conduit between said return port and said inlet.

14. The fuel injection system of claim 13 further comprising control means for operably varying an effective flow area of said variable restriction to maintain a substantially constant, positive pressure in said first conduit.

15. The fuel injection system of claim 12 wherein said pressure regulating means comprises a constant pressure pump in said first conduit for pumping fuel from said fuel supply tank to said inlet.

16. The fuel injection system of claim 15 wherein said constant pressure pump is a mechanical displacement pump.

17. The fuel injection system of claim 15 wherein said constant pressure pump is an electrical displacement pump.

18. The fuel injection system of claim 15 further comprising control means for varying displacement of said constant pressure pump proportional to engine speed to maintain a substantially constant, positive pressure in said first conduit.

19. The fuel injection system of claim 12 further comprising means for cooling fuel in said first conduit between said return port and said inlet.

20. The improvement of claim 1 wherein said pump means has an inlet directly connected by a first conduit to said return port.

* * * * *